United States Patent [19]

Osada

[11] Patent Number: 4,647,000

[45] Date of Patent: Mar. 3, 1987

[54] FLEXIBLE MOLD FOR FORMING SIMULATED TILE OR BRICK SURFACES

[76] Inventor: Hideharu Osada, 12-1, Tomiokita 2-chome, Nara-shi, Nara, Japan

[21] Appl. No.: 728,790

[22] Filed: Apr. 30, 1985

[30] Foreign Application Priority Data

May 2, 1984 [JP] Japan ..... 59-89813

[51] Int. Cl.[4] ..... B28B 7/06; B28B 7/36

[52] U.S. Cl. ..... 249/83; 249/127; 249/129; 249/132; 249/150; 249/183; 425/DIG. 44; 428/40; 428/131

[58] Field of Search ..... 249/112–115, 249/15, 127, 16, 140, 60, 183, 132, 134, 142, 145, 150; 264/299, 338, 213, 245–247, 333; 425/DIG. 44; 428/40, 131

[56] References Cited

U.S. PATENT DOCUMENTS

| | | | |
|---|---|---|---|
| 1,571,849 | 2/1926 | Long | 264/245 |
| 1,583,748 | 5/1926 | Reuter-Lorenzen | 264/245 |
| 1,635,684 | 7/1927 | Mell | 264/245 |
| 1,666,232 | 4/1928 | Boynton | 425/DIG. 44 |
| 1,917,062 | 7/1933 | Reinhard | 249/15 |
| 2,059,520 | 11/1936 | Harshberger | 264/246 |
| 2,616,145 | 11/1952 | Dufford | 249/15 |
| 3,721,418 | 3/1973 | Vincent | 249/112 |
| 4,477,366 | 10/1984 | Robertson | 264/213 |
| 4,480,006 | 10/1984 | Rampf et al. | 264/213 |
| 4,481,324 | 11/1984 | Hall et al. | 264/213 |

FOREIGN PATENT DOCUMENTS

| | | | |
|---|---|---|---|
| 2142904 | 3/1973 | Fed. Rep. of Germany | 249/115 |
| 2309798 | 9/1974 | Fed. Rep. of Germany | 249/115 |

*Primary Examiner*—Willard E. Hoag
*Attorney, Agent, or Firm*—Darby & Darby

[57] ABSTRACT

A flexible grid or lattice molding form having a release-layer covered adhesive on one major side surface and a peelable layer on the opposite major side surface. The grid or lattice can be adhered to a preformed wall or flow by the adhesive layer and a cement mixture sprayed on troweled thereover. The upper peelable surface then can be stripped off removing any molding material covering the peelable layer.

9 Claims, 8 Drawing Figures

FIG. 8
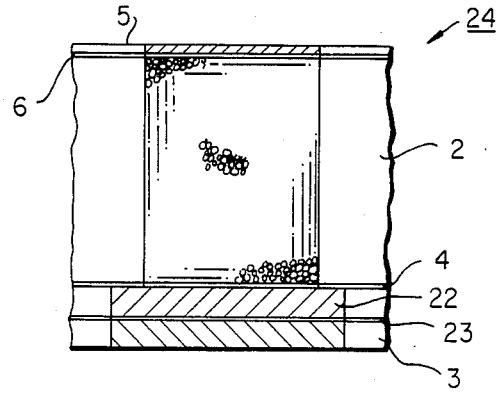
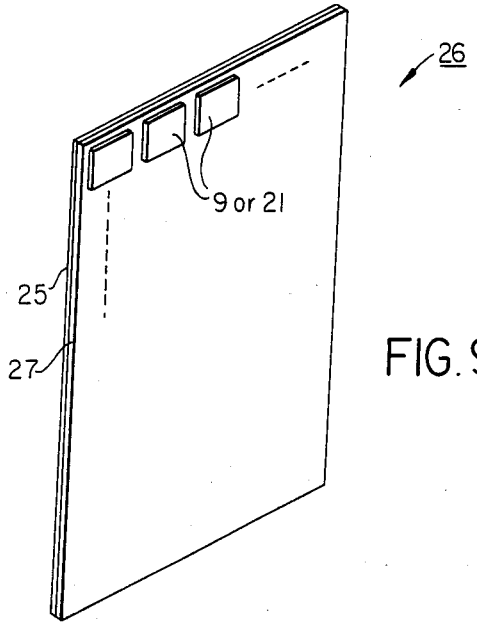
FIG. 9

FLEXIBLE MOLD FOR FORMING SIMULATED TILE OR BRICK SURFACES

BACKGROUND OF THE INVENTION

The present invention relates to a method for decoratively finishing the wall surface or the like by use of a spraying or trowelling material and an improvement in making such pattern molding frames used therefor. More specifically, the invention relates to a method for forming easily and without fail a surface having various kinds of deep and distinctively sharp apex lines of masonry joint patterns, impressed lines patterns or other rugged surface patterns for walls, columns, ceilings and floors of the architectural building, surfaces of roads, passageways, bridges, land bridges, surfaces of various kinds of panels and boards to be used for the interiors, exteriors and floors, and to a pattern frame therefor.

For past several years, a fashionable trend to finish the wall surface of a building having a luxury impression by laying up bricks or tiles is beginning to show up. Such decorative patterns are obtained by adhering a molding frame made of plastics film or a cardboard having punched out the masonry joint parts in the first stage, and then afterward spraying the spray material over the entire surface, the molding frame is peeled off, leaving the the masonary joint parts to appear. Consequently, the efficiency is greatly enhanced when compared with the conventional architectural method of laying up a brick or a tile piece by piece.

It is necessary in this connection to peel off the pattern molding frame at a point of time right after the spraying or when the spraying material becomes half solidified in drying. For this reason, sagging of sprayed material is inevitable and the apex lines lose their sharpness, and become dull and round. Curtaining of the sprayed material will result when sprayed in deep thickness. Thus, the problem with this technique is that only the wall surface of thin jaggedness is obtainable.

In order to overcome this shortcoming, the inventor of this invention has developed a pattern frame of masonry joint pattern made by laying up in a multiplicity of plastic film (Japanese Utility Model Application No. 174954/1983. Also, he has developed a pattern molding frame made of foamed polystyrene which is suitable for a thick application of spraying, which can be dissolved after the sprayed material is solidified. (Japanese Utility Model Application No. 10896/1984 A shortcoming with the former method is that peeling off one film after another is very troublesome, while the problem with the latter is that the dissolved polystyrene residue sticking to the masonry joint parts impairs neat appearance.

SUMMARY OF THE INVENTION

The object of this invention is to offer a method for forming an arbitrarily intended design pattern having an arbitrary thickness on the surface of a wall of an architectural building, a road surface or various kinds of decorative panels and board by use of a spraying or trowelling material with ease and sureness.

Another object of the invention is to offer with ease and sureness a method for forming protruded parts having a distinctively sharp edge and apex lines without accompanying sagging and flushing on the wall surface or the like. More specifically, it is aimed at by this invention to offer a method capable of obtaining uniform thickness in finishing or determining the width of the masonry joints which is difficult even for skilled artisans by use of a trowel or a roller with ease even by a layman.

Still another object of this invention is to offer a method of forming a pattern of rugged surface on the wall having embedded metal plates in the dent portions such as the masonry joint parts.

These objectives can be attained with a pattern molding frame having a dual structure consisting of a main pattern molding frame and a covering material for forming rugged surface on the wall where molding frame is to be adhered, the surface forming part applied on the top of the molding frame being to be removed at a stage when the formed part become solidified and the main pattern molding frame itself being to be removed when the protruded part material becomes solidified to some degrees.

Furthermore, this invention offers a pattern molding frame for forming various kinds of rugged surface of recession and protrusion design pattern having a deep and sharply distinctive apex lines and also a pattern molding frame having incorporated a plate-like part which is to be buried into the recessed portions such as masonry joint parts as one unit.

BRIEF DESCRIPTION OF THE DRAWINGS

FIG. 4(*b*) are a partially enlarged sectional view showing still other different pattern molding frame example.

FIG. 5(*b*) is a perspective view of a masonry joint pattern having been formed by use of a pattern molding frame shown in FIG. 5(*a*).

FIG. 8 is a partially enlarged sectional view showing a pattern molding frame wherein the plate-like body having been formed in one unit with the pattern molding frame.

DETAILED DESCRIPTION OF THE INVENTION

Figure 1:
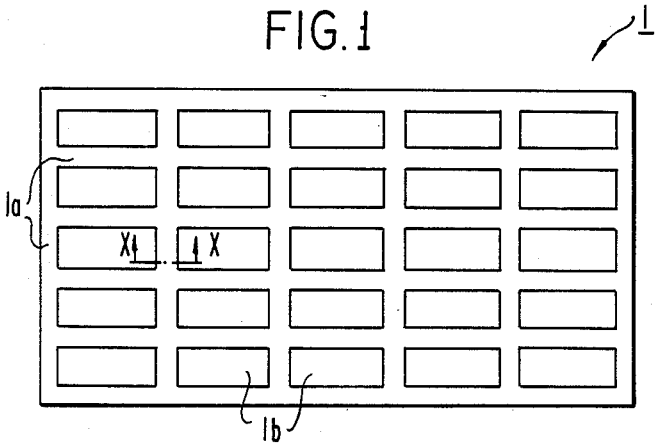
FIG. 1 is a plan view showing one example of a pattern molding frame for forming masonry joint parts.

Hereinafter, detailed description of the present invention will be made according to the appropriate embodiments as shown in the drawings.

Figure 2:
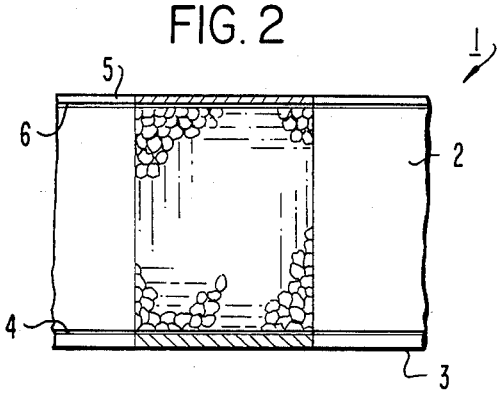
FIG. 2 is an expanded sectional view along X–Y line in FIG. 1.
Figure 3C:
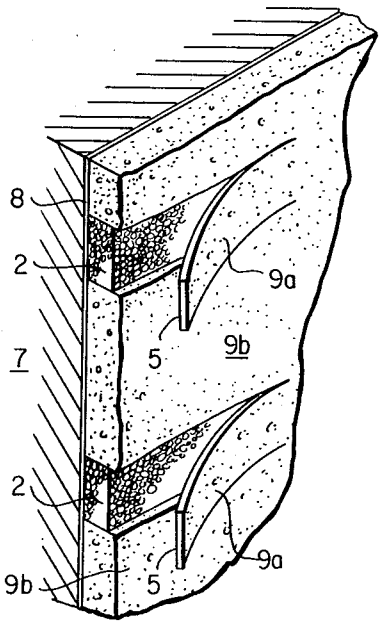
FIGS. 3(*a*) through (*f*) are illustrative views showing the procedural order for forming masonry joint pattern by spraying on the wall surface using a pattern molding frame by the present invention, in which (*a*), (*b*) and (*e*) are sectional side view and (*c*), (*d*) and (*f*) a are perspective view.
Figure 3B:
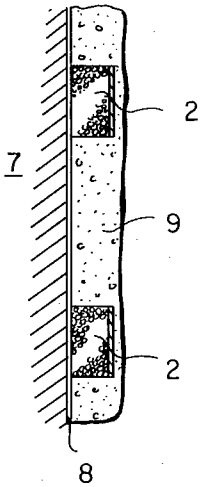
Figure 3A:
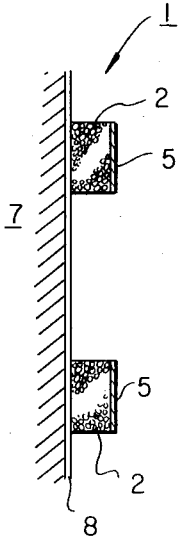
Figure 3F:
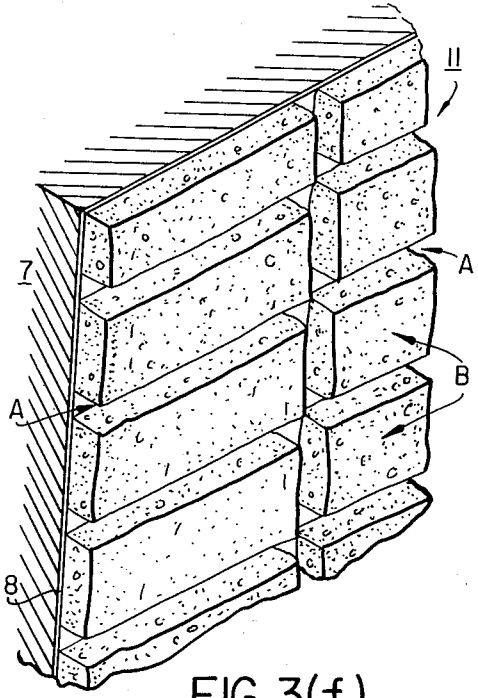
Figure 3E:
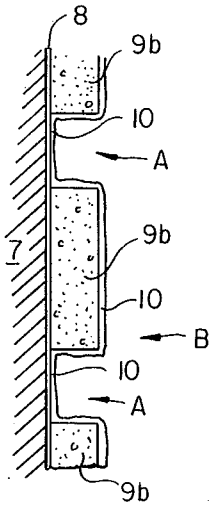
Figure 3D:
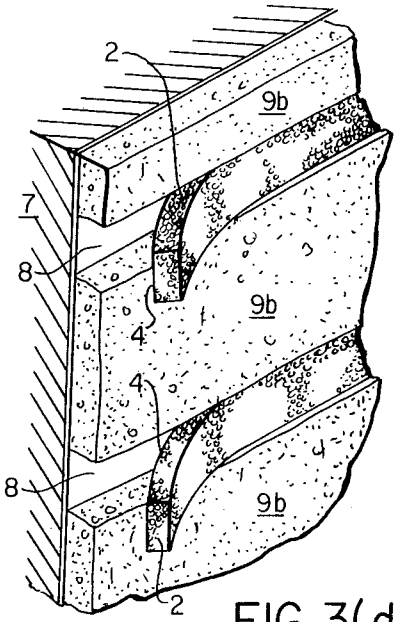

FIGS. 1 and 2 show an example of a design pattern molding frame in accordance with the present invention for forming rugged surface patterns such as the masonry joints at an intended work area. This pattern molding frame (1) comprises a main body (2) of the pattern molding frame made of foamed polyethylene having a design pattern of the masonry joints, on the back side of which a peeling paper (3) having the same desgn pattern of the masonry joints is adhered with a peeling type adhesive (4), consisting one unit as a whole. On the surface of said main unit (2) of the pattern molding frame, a covering material (5) having also the same design pattern of said masonry joints is adhered with the adhesive. And this pattern molding frame (1) is formed by removing the unnecessary parts by a punching machine, a laser beam or a hydraulic press, after being laid up on a peeling paper and being sandwiched between a foamed polyethylene sheet whose upper surface is processed to be peelable (coated with a peeling type adhesive) and its underside surface is coated with an adhesive, and a thin plastic film having been coated on its lower side surface coated with an adhesive for the covering purpose. Said peeling paper may be left without being punched out. Symbol 1*a* in the drawing is the masonry joint part, and Symbol 1*b* is the punched out part. A plastic film, a foamed polyethylene sheet and a peeling paper having been punched out in advance of their masonry joint parts may be laid up with a peeling type adhesive in-between into one unit body.

This foamed polyethylene sheet is made by slicing the molded block or by extruding in a sheet form. For continuous production on a large scale, the extrusion method is usually preferred. The thickness of the foamed polyethylene sheet is arbitrarily selected. However, a range of 2 to 20 mm in thickness, about 5 mm in thickness in particular, is preferred for use in ordinary masonry joint design patterns. On the other hand, as for the expansion rate, 5 to 50 times in expansion rate for foaming is usually used. For withstanding the tensile strength at the time of peeling off, rather low expansion rate are recommended.

Description will be made hereinafter on the method of forming the recess and protrusion patterns by use of the above-mentioned pattern molding frame (1). As shown in FIG. 3(*a*), the preparation of the ground for smoothing the surface is the first step to be carried out. As the next step, spraying of water-proof barrier paint (8) is applied, for instance, in a quantity of about 0.3 $kg/m^2$ by spraying uniformly. A part of this water repellent coated layer becomes the color of the masonry joints later. Note, however, the ground preparation work may be done in a very terse, simplified, abridged manner, since the protruded parts can be made in a thick layer according to this invention. The water-proof barrier painting (5) may be dispensed with when a transparent paint (10) is used as a substitute. The masonry joint parts may be formed by coating cement or a mixture of cement with some emulsion type plastic resin with a trowel or a roller.

After said paint (8) is dried up, the main body (2) of the pattern molding frame is stuck after peeling off the peeling paper.

In the next step, skin forming type spray material (9) consisting of emulsion type acrylic resin as its main component is sprayed on with a spray gun uniformly over the entire wall surface area. The aperture of nozzle of the gun is in this case about 3 to 10 mm for the spraying operation with an air pressure of about 2 to 7 $Kg/cm^2$. The material to be sprayed is preferably cream like substance of high viscosity which is not going to sag easily and is sprayed in minuscule ball or granular form. The volume to be sprayed is about 4 to 50 $Kg/m^2$, being not definite as it depends upon the thickness of the protruding portion of the work, that is the depth of the molding pattern frame (2) (the depth of the frame being 2 to 20 mm in depth for the protruding portion). Meanwhile, however, the thickness of spray at the protruding portion may be either thicker or thinner than the depth of the frame. If sprayed too thickly, sagging will result, 2 to 5 mm in thickness being the limit. When the powder of bricks, porcelains or natural stones is used as the spraying material, the appearance after the finish will become very much like the original material.

Only the covering material (5) is removed one by one while the sprayed material (9) is still not sufficiently dried (after about one hour of spraying) as in the case of FIG. 3(*c*). The sprayed material deposited over the main body of the pattern molding frame will be then exposed together with covering material (5), exposing the foamed polyethylene constructing the frame itself.

After the sprayed material (9*b*) left unremoved becomes sufficiently dried (for instance, after 24 hours), for instance, after 24 hours, the main body (2) of the molding frame is removed from the wall surface (FIG. 3(*d*)). In this case, no flush will be left because the sprayed material (9*a*) deposited on the main body of the frame had been removed in the preceding process. The molding frame (2) can be removed rather easily and assuredly, since the molding frame is now contacting with the sprayed material (9*b*) at its side surface only, and moreover, the sprayed material is now sufficiently dried and has somewhat shrunk.

In the next stage, as seen in FIG. 3(*e*), a transparent paint (10) such as acrylic or urethane resin paint, for instance, is applied in uniform thickness over the entire surface in a quantity of about 0.2 to 0.5 $Kg/m^2$, which imparts luster and water-repellent effect as well as endurance to the sprayed material (9*b*) and the masonry joint parts. Thus, as shown in FIG. 3(*f*), the masonry joint parts (a) is obtained in the color of said paint (8) and the protruding parts (B) in the color of the sprayed material for the finished wall surface.

From the consideration as to the material strength and cost, the material to be used for the main body (2) of the molding frame, the inventor has adopted foamed polyethylene. It is of course possible to use polypropylene, polystyrene (high impact type, general purpose type), polyurethane, polyvinyl chloride, rubber as well as those modified versions of these materials copolymers of these resins. On the other hand, soft plastic materials or rubber that are not foamed can be used besides foamed plastics. But foamed plastics are preferred because they are more flexible and easier to be adhered and also ligher in weight as well as cheaper in cost.

The expansion rate for foaming may be arbitrary. In the case of foamed polystyrene or foamed polyurethane, however, which are rather weak in tensile strength, rather lower expansion rate are recommended. It is also recommended that a plastic film (13) is laminated, as in the case of pattern molding frame (12) shown in FIG. 4(*a*), on the under-side of the main body (2) of the frame for the purpose of reinforcement. Reinforcement with a plastic film is naturally feasible to other foamed plastics.

Figure 4A:
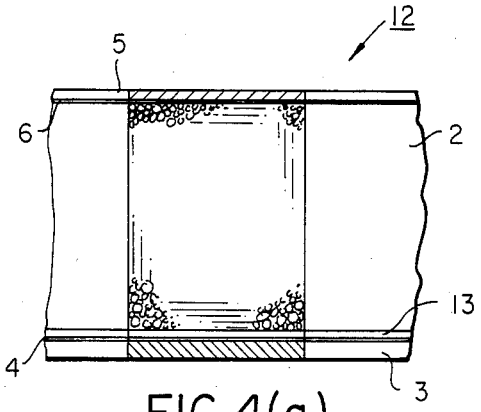
FIG. 4(*a*) is a partially enlarged sectional view showing another example wherein the main unit of the pattern molding frame is reinforced with a plastic film.
Figure 4B:
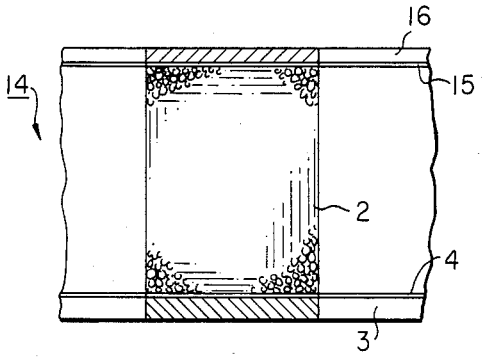
Figure 4C:
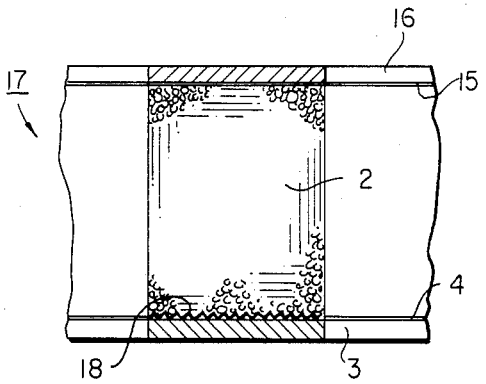

The pattern molding frame (1) (12) in the preceding examples (FIG. 2, FIG. 4(*a*)) are coated with a demolding agent on their upper side surface and the adhesive on the other surface. Reversing of this process in coating may be adopted. In other words, the pattern molding frame (14) as shown in FIG. 4(*b*) is coated with the adhesive (15) on its top surface, while its under-side surface is coated with peeling agent (16).

Furthermore, the main body (2) of the pattern molding frame (17) shown in FIG. 4(*c*) is subject to anchoring treatment (18) on its lower side. By processing the under-side of the main body of the pattern molding frame with corona discharge or other physical and chemical treatment having anchoring effect, the adhesion is made more effective and firm, which will help enhance the efficiency in removing the adhesive from the masonry joint part surface without leaving any residue. It is to be noted that the top side of the main body (2) of the frame is all the same as in the case of FIG. 4(*b*).

For the covering material (16) of the pattern molding frame shown in FIG. 4(*b*), a waxed thick gauge paper is used as the peeling paper (3).

The form of the main body of the pattern molding frame is not limited to the one which is continued in its recession part as in the instance of masonry joints as in said examples. They can have various other forms of patterns such as "impressed lines", band, circular, triangular and other geometrical patterns in which the recessed parts are not continuous one from another. In the interest of easiness in removing the covering materials (5) (16), however, it is preferred that they are continued in pattern to some degrees.

In order to assure easy demolding of the main body (2) of the pattern molding frame from the sprayed material (9*b*), a demolding effect treatment may be applied. Such demolding effect treatment is done, for instance, by application of a demolding agent to the sides of the molding frame or by blending surface active agent or fatty acid in advance to the formulation of foamed plastics. Attention should be paid, however, in the case of the latter to an appropriate quantity in the formulation in relation with the adhesive strength of the adhesive to be applied to the under-side of the frame.

Figure 5A:
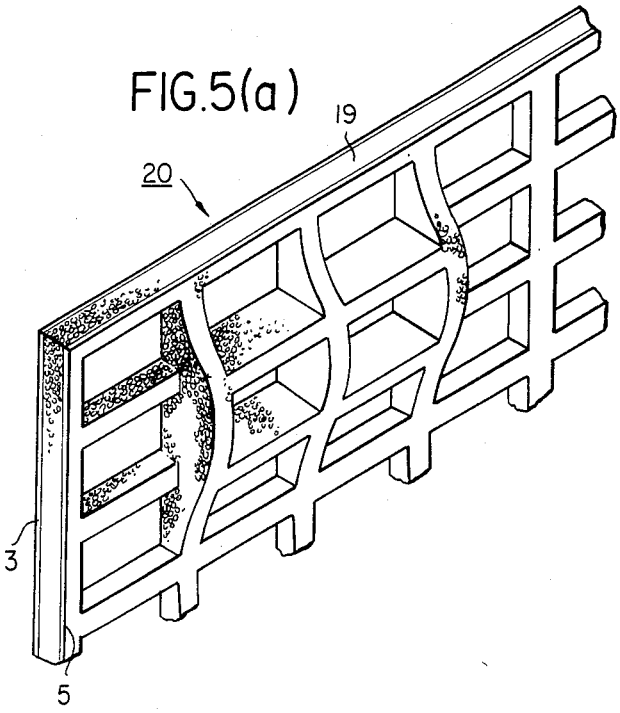
FIG. 5(*a*) is a perspective view showing another pattern molding frame wherein the surface of the pattern is partially protruded.
Figure 5B:
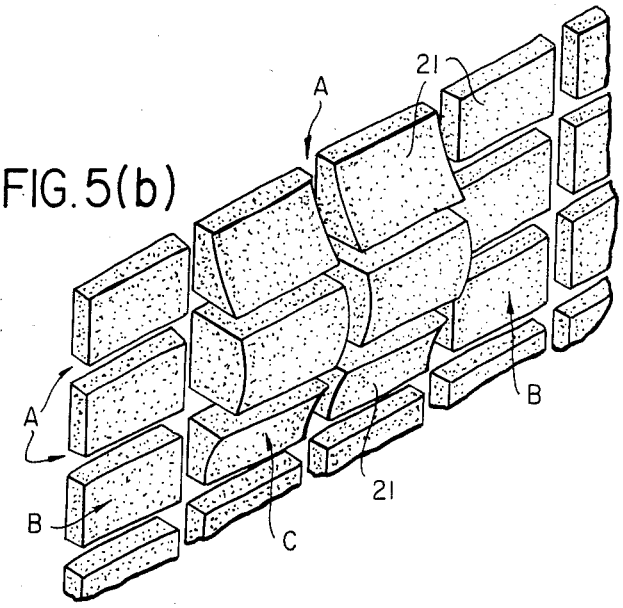

With regard to the main body of the frame, it is not limited to a flat one as shown in the preceding examples. As in the instance of FIG. 5(*a*), there is the one having a partially protruded molding frame made by molding or by cutting on one side of such pattern molding frame. By use of such pattern molding frame (20) having incorporated said protruding portion in the main body, the wall surface provided with such a partially protruded pattern is obtainable as it is seen with FIG. 5(*b*).

On the other hand, such plastic films as polyethylene, polypropyrene, nylon, polyester and polyvinyl chloride can be suitably used as a covering material (5) (16). Besides, thick gauge papers, waxed papers, oiled papers as well as synthetic papers will be used as well for the same purpose. Too thick ones of these materials will leave difference in height after the molding frame is removed. For this reason the covering material is preferred to be as thin as possible, although there is a case when the covering material of a thick gauge left unremoved is used after the molding frame is removed as a sort of decoration.

There is also another method to laminate a layer of a thin, strong covering film by spraying a plastic resin on the foamed plastic frame.

It is needless to point out that besides the wall surface, the technique can be applied to the interior and exterior surfaces of pillars, columns, ceilings, floors, stairways and panels as well as the boards constructing them, and also the surfaces of roads, passageways, bridges and land bridges. As for the materials to be used for forming the protrusion parts, besides those aforementioned materials, many other materials both organic and inorganic such as cement, plaster, mixture of cement and emulsion type resins and trowelling materials of emulsion type resins, which are superior in hardness and anti-abrasive property, are possible to be used with spray guns, trowels and rollers in accordance with the area for application.

Especially in the case for trowelling, various ways of finishing technics are possible depending upon the method of trowelling. For instance, in the case of the pattern molding frames shown in FIG. 5(*a*), use of a colored cement is recommended for trowelling.

In case when the entire surface is applied by trowelling, the finish has an appearance of the tiles having been adhered. (The finish is further flat than the case shown in FIG. 3(*f*)) In this case, when finished flush with the molding frame surface, a protruded surface of neat appearance is obtainable, including the parts of the masonry joint parts, even by a layman. According to the present invention, therefore, no skilled labor of a plasterers nor of a brick layers is required. Regardless of the area involved, the work can be done by the hands of layman, saving a lot of cost.

Figure 6:
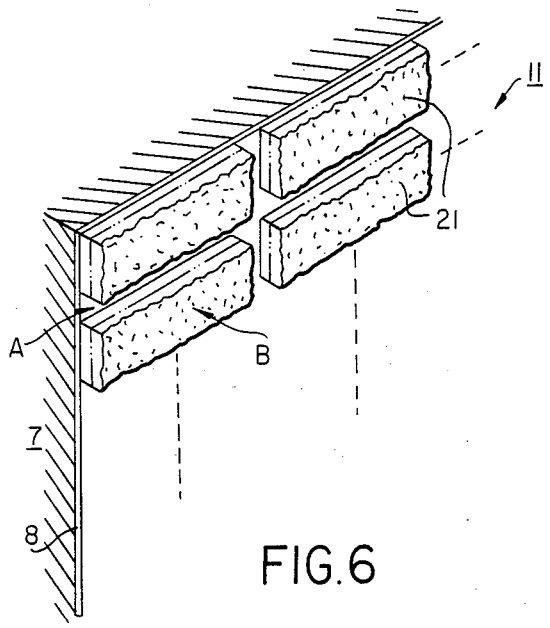
FIG. 6 is a perspective view of a masonry joint design pattern formed by use of a trowelling material.
Figure 7A:
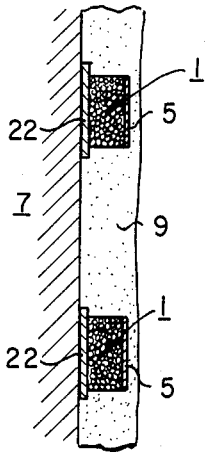
FIGS. 7(*a*) through (*d*) are illustrative views showing the the order for forming a masonry joint design pattern having been formed by embedding a plate like material for masonry joint forming material, by use of a pattern molding frame design shown in FIG. 1, wherein (*a*), (*b*) and (*c*) are a sectional view, while (*d*) is a perspective view.
Figure 7B:
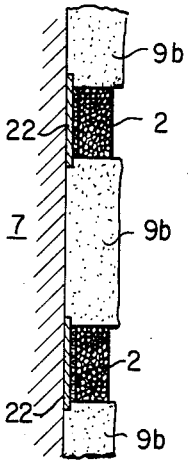
Figure 7C:
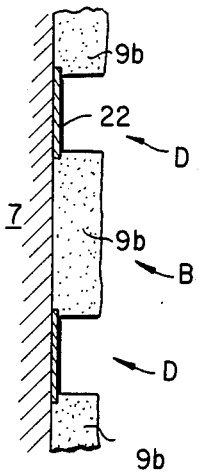
Figure 7D:
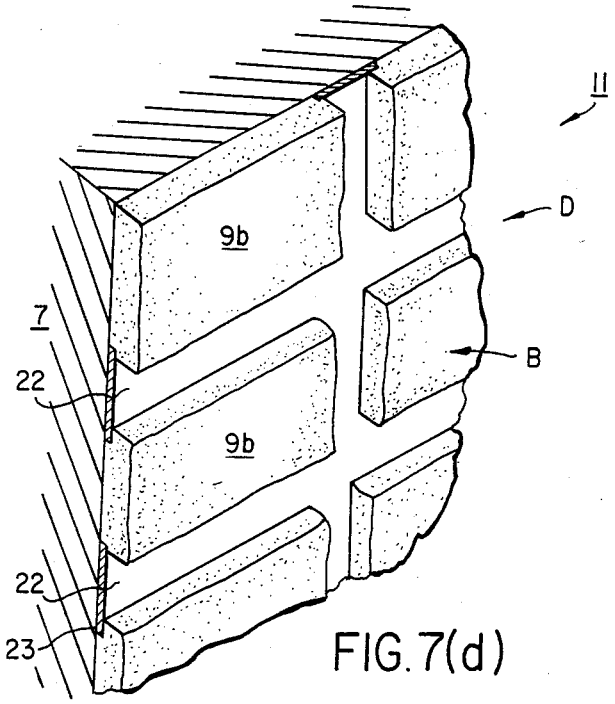

Furthermore, it is also possible to finish the rough, rugged with a trowel. FIG. 6 shows a pattern made in this way. It has a finish having an appearance as if crushed natural stones and bricks were adhered on the surface which was obtained by coating the trowelling materials in a thicker layer than the molding frames by several millimeters and then removing the thickly laid covering material (16) in a rough manner. However, the masonry joint portions are finished neatly by use of the main body (2) of the frame.

FIG. 7 shows another example having formed by embedding metal plate bodies, stone or other plate member (22) at the predetermined masonry joint portions. In this case, as shown in FIG. 7(*a*), plate members (22) are first fixed temporarily with the adhesive (23) at the predetermined positions on the wall ground corresponding to the parts of masonry joints of the molding frame and then the main body (2) of the molding frame is stuck in place for later spraying on of spray material (9). In case when the plates (22) are made of metal without joints, water-proof barrier may be dispensed with. Wood plates may be used when the wall is in the indoor.

In the next stage when the sprayed material (9) is still not dried up, the covering material (5) and the sprayed material (9*b*) over it are removed. (FIG. 7(*b*)) After the other parts of the sprayed material left unremoved are sufficiently dried, the main body of the molding frame is removed from the plate member (22) (FIG. 7(*c*)). Thus the wall surface having a rugged surface composing of the plate member (22) of the masonry joint pattern (D) as shown in FIG. 7(*d*) is completed. A transparent paint (10) may be applied after or before the main frame body (2) is removed.

Since these plate members (22) are buried under the sprayed material (9*b*), they are completely fixed in position, having no fear of dropping off or being peeled off. With the surface of the masonry joint parts being formed with a metal such as aluminum, stainless steel or stone such as marble, granite or a decorative timber, the wall has a highly luxurious impression. Moreover, even when the width of these plates are approximately same as the molding frame, if the plates are fixed with the adhesive, they are held firmly in position because both sides of these plates are sustained by the sprayed material. The method of using these plate member bodies for the rugged surface pattern can be utilized in the same way as in other patterns having a rugged surface.

Meanwhile, as seen in FIG. 8, another molding frame (24) incorporating the plate member (22) and the main frame body (2) into one unit may be made. For instance, this is a molding frame stuck with metal plate member on its bottom in which an aluminum plate having been adhered with a peeling paper (3) which is cut in a size somewhat larger than the frame body (2) stuck with the main molding frame.

FIG. 9 shows a decorative board having formed a rugged surface pattern on a board (25) which is used in place of the wall ground in the preceding examples. This board is made by spraying or by trowelling the masonry joint part surface on a board (25), over which a rugged surface pattern is formed by applying the spray material (9) or the trowelling material (21). This decorative board can be manufactured in mass production basis, and also can be fixed easily by mere nailing on the wall, not requiring any spray or trowel works at the site for quick, easy finish.

As described in details in the above, according to the present invention, a recessed portion exactly after the molding frame is obtained on the processing surface by first fixing the molding frame having been covered with a covering material for peeling, which is peeled off together with the protrusion forming material that was stuck over it after applying the spraying material or the trowelling material for forming the protruding pattern portion while it is still not solidified in drying, and in a later stage when the protrusion forming material is dried up and solidified, the molding frame is removed.

In this manner a rugged surface pattern having a deep and distinctively sharp-edged apex lines is obtainable by a simple operation assuredly which could not be attained in the conventional method. Furthermore, the neat finish without flush is obtained in a same level having a good contrast as the one adhered with natural stones and bricks. The recessed portion constructs the under-layer having been applied with water-proof barrier paint. A variation with the plate member having been embedded is also available.

The surplus processing labor that is involved in executing the present invention is limited only to the removing of the covering material (5)(16) and the main frame body (2) once for each of them, which means not much when compared with the conventional finishing works which involve a lot of spraying and trowelling. When compared with the troublesome labor involved in laying tiles and bricks, it means a big cost trimming.

The method according to the present invention has a big advantage in that even a certain thickness for protrusion and masonry joints in uniform depth can be wrought out by a layman even for a large area.

Meanwhile, the molding frame by the present invention is that its deep, soft surface is covered with a covering material for later peeling off, while adhered with a peeling paper on its back side.

Consequently, the molding frame is easy for use and can be applied to any surface, and a neat, rugged surface pattern with no flush and having distinctively sharp-edged apex lines of the protrusion parts can be obtained easily and assuredly. Furthermore, because the molding frames can be fabricated very easily, and the products with them can be arbitrarily in any varieties as to the form, height and depth of the rugged surface pattern in design using the materials available from the manufactures on a mass production basis in big quantities and in uniform quality at a low cost. So the utility value of this invention is very great.

What is claimed is:

1. A molding frame for forming a textured pattern on a substantially flat surface comprising:
   - a pliable negative mold of a masonry joint lattice pattern;
   - an adhesive layer applied to a surface of said negative mold to be disposed against a preformed surface;
   - a removable release layer applied to said adhesive layer, such that said adhesive layer remains applied to said bottom surface upon removal of said removable release layer; and
   - a peelable top layer applied to the top surface of said negative mold, said peelable top layer having the same masonry joint pattern as said negative mold.

2. The molding frame of claim 1 wherein said pliable negative mold is foamed plastic.

3. The molding frame of claim 1 wherein said pliable negative mold is rubber.

4. The molding frame of claim 2 wherein said foamed plastic is polyethylene.

5. The molding frame of claim 1 wherein said pliable negative mold is reinforced with a plastic film layer between said bottom layer and said adhesive layer.

6. The molding frame of claim 1 wherein said mold is formulated with a surface active agent or a high quality fatty acid.

7. The molding frame of claim 5 wherein said mold is formulated with a surface active agent or a high quality fatty acid.

8. The molding frame of claim 1 wherein side surfaces of said mold is coated with a demolding agent.

9. The molding frame of claim 5 wherein the side surface of said mold is coated with a demolding agent.

* * * * *